US008430765B1

(12) United States Patent
Galloway

(10) Patent No.: US 8,430,765 B1
(45) Date of Patent: Apr. 30, 2013

(54) REDUCED TURF DRAG GOLF CLUB HEAD

(75) Inventor: J. Andrew Galloway, Escondido, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 13/596,356

(22) Filed: Aug. 28, 2012

Related U.S. Application Data

(63) Continuation of application No. 12/627,966, filed on Nov. 30, 2009, now abandoned.

(60) Provisional application No. 61/138,037, filed on Dec. 16, 2008.

(51) Int. Cl.
*A63B 53/04* (2006.01)

(52) U.S. Cl.
USPC ..... 473/328; 473/345; 473/349

(58) Field of Classification Search ..... 473/324–350
See application file for complete search history.

(56) References Cited

U.S. PATENT DOCUMENTS

| | | | | |
|---|---|---|---|---|
| 3,997,170 | A | 12/1976 | Goldberg | |
| 4,065,133 | A | 12/1977 | Gordos | |
| 4,498,673 | A | 2/1985 | Swanson | |
| 5,131,986 | A | 7/1992 | Harada et al. | |
| 5,531,444 | A | 7/1996 | Buettner | |
| 5,603,667 | A | 2/1997 | Ezaki et al. | |
| 6,196,936 | B1 | 3/2001 | Meckel | |
| 6,346,052 | B1 | 2/2002 | Chappell | |
| 6,402,636 | B1 * | 6/2002 | Chang | 473/324 |
| 6,475,099 | B1 * | 11/2002 | Sumitomo et al. | 473/290 |
| 6,607,452 | B2 | 8/2003 | Helmstetter et al. | |
| 6,638,179 | B2 | 10/2003 | Yoshida | |
| 6,659,884 | B2 * | 12/2003 | Knuth | 473/329 |
| 6,852,273 | B2 | 2/2005 | Ivanov et al. | |
| 6,881,159 | B2 | 4/2005 | Galloway et al. | |
| 6,939,248 | B2 | 9/2005 | Naruo et al. | |
| 6,974,392 | B2 * | 12/2005 | Chang | 473/324 |
| 7,063,628 | B2 | 6/2006 | Reyes et al. | |
| 7,083,525 | B2 | 8/2006 | Pond et al. | |
| 7,128,664 | B2 * | 10/2006 | Onoda et al. | 473/347 |
| 7,211,006 | B2 * | 5/2007 | Chang | 473/329 |
| 7,320,832 | B2 * | 1/2008 | Palumbo et al. | 428/548 |
| 2002/0004426 | A1 * | 1/2002 | Lin et al. | 473/324 |
| 2002/0111228 | A1 * | 8/2002 | Chang | 473/324 |
| 2003/0072948 | A1 * | 4/2003 | Krepski et al. | 428/423.1 |
| 2003/0148822 | A1 * | 8/2003 | Knuth | 473/345 |
| 2004/0009354 | A1 * | 1/2004 | Krepski et al. | 428/423.1 |
| 2004/0204265 | A1 * | 10/2004 | Chang | 473/346 |
| 2006/0287126 | A1 * | 12/2006 | Aisenbrey | 473/316 |

FOREIGN PATENT DOCUMENTS

| | | | |
|---|---|---|---|
| GB | 2469036 | A * | 10/2010 |
| JP | 02234777 | A * | 9/1990 |

* cited by examiner

*Primary Examiner* — Alvin Hunter
(74) *Attorney, Agent, or Firm* — Michael A. Catania; Rebecca Hanovice; Sonia Lari

(57) ABSTRACT

The present invention relates to a fairway wood type golf club head having a striking plate, a crown and a sole. The sole comprises a flat high strength region and dual regions with a low-friction, high release coating.

3 Claims, 4 Drawing Sheets

REDUCED TURF DRAG GOLF CLUB HEAD

CROSS REFERENCES TO RELATED APPLICATIONS

The present application is a continuation application of U.S. patent application Ser. No. 12/627,966, filed on Nov. 30, 2009, which claims priority to U.S. Provisional Patent Application No. 61/138,037, filed on Dec. 16, 2008, now abandoned, both of which are hereby incorporated by reference in their entireties.

STATEMENT REGARDING FEDERALLY SPONSORED RESEARCH OR DEVELOPMENT

Not Applicable

BACKGROUND OF THE INVENTION

1. Field of the Invention

The present invention relates to a golf club head. More specifically, the present invention relates to a fairway wood type golf club head.

2. Description of the Related Art

The prior art discloses various methods to reduce turf drag of a golf club head. One such example is U.S. Pat. No. 4,498,673 issued to Swanson for Golf Club.

This patent discloses a utility golf club wood with a single round bump or projection which adds mass behind the sweet spot of the club face without materially increasing the weight of the club head and at the same time reduces the turf drag to produce longer and more accurate drives.

Another example is U.S. Pat. No. 4,065,133 issued to Gordos for Golf Club Head Structure, which discloses grooves on the bottom or sole of the club head to minimize the surface of the head that may contact the ground surface just prior to the striking surface of the head impacting a golf ball.

Yet another example is U.S. Pat. No. 3,997,170 issued to Goldberg, which discloses the use of a plurality of parallel grooves formed in the lower face, normal to the striking face to reduce air and ground friction.

Golf balls are hit from where they lie for all shots except the first on a hole. To hit a shot of preference, the club head comes in contact with the turf at or prior to impacting the ball. Turf on the fairway is cut and leveled to ease the shot making from the surface, but surface interaction is still a component in producing the subsequent trajectory. Different clubs are used as the player's ball advances closer to the putting green. This sequentially closing on the target and the decreasing distance to the target allows the use of specialized clubs to better achieve the desired result. The turf varies from a smooth and well cut down fairway to increasing tall grasses bordering the fairway, to rough, uncontrolled grasses and terrain well away from the fairway. These conditions can and do make it difficult to strike the ball well from these various lies. In addition to terrain and lawn difficulties, there can be a detrimental wetness to the grasses and variations in the compaction of the soil. Club heads in these conditions can be significantly impeded by the terrain. Further, the orientation and path of the club head can be adversely altered.

BRIEF SUMMARY OF THE INVENTION

The purpose of the present invention is to overcome much of the detrimental turf and head interactions that occur during play. The present invention includes features to improve turf/soil interaction and drag due to wet grasses. The purpose is to create a sole shape for fairway woods that performs consistently well on and off the fairway. This is accomplished in the contours on the sole and by coatings. The coating purpose is to reduce the drag effects of wet grasses on the club head. This is accomplished with a low drag coating or by a dual purpose coating.

The present invention uses a near flat center sole with hull like feature either side of the approximately flat center. The flattened portion will diverge upward after the length is double the offset of the center of mass from the face center. The flat portion's surface will be a strong material, preferably hard and smooth, which is accomplished by the specification of the material and the heat treatment of the material and/or a durable hard surface coating. Alternatively, the surface is a secondary structure bonded or otherwise attached to the body of the club head. The purpose of the flat area is to increase the surface area impacting the turf to reduce the pressure of the soil features on the club. The reduced loading minimizes the penetration of soil particulates into the sole surface and thus reduces energy loss in the interaction. The flatness also normalizes diversions due to contour differences between the turf and the sole.

The hull like features are contoured surfaces that blend the flatten sole to the body of the club head. The contoured surfaces make a contact with the grasses and other debris near the soil. A coating is preferably used to reduce the drag associated the sliding along the grasses, particularly if they are wet. The coating is a low friction surface and preferably includes texture to further minimize the surface drag. A preferred coating is a TEFLON based coating. Alternatively, the coating is a plastic based coating or hard coatings such as nano-metal and other smooth metal depositions.

The new aspects of the present invention include purposeful shaping of the sole and the immediately body above the sole. The sole is optimized for turf interaction and hardness, strength; the area above the sole is designed for low drag through the turf and grasses. The application of a low friction, water repelling coating is a new aspect. The application of advanced metal secondary coatings, including nano-metal coatings is a new feature and application of these coatings.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
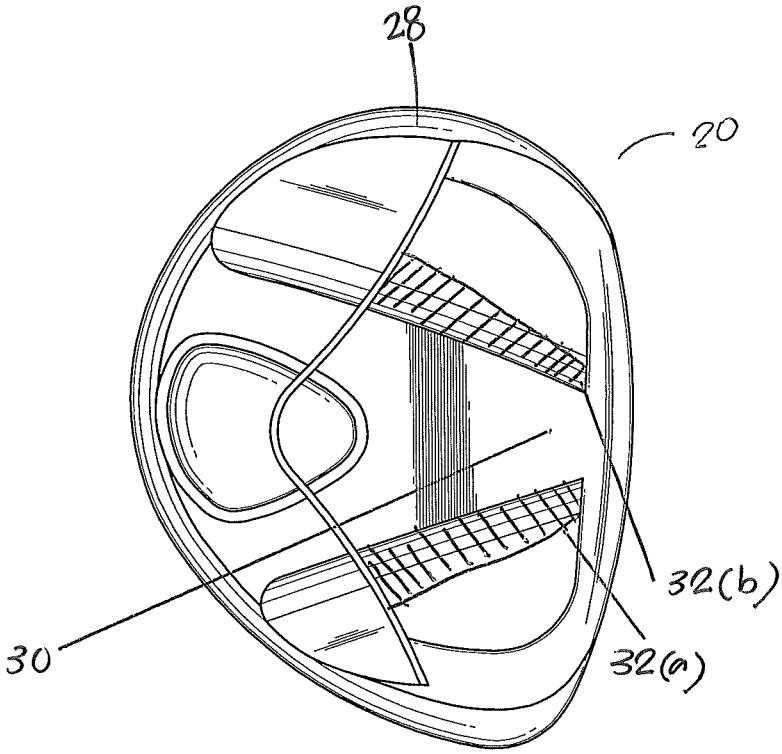
FIG. 1 is a bottom plan view of a golf club head.
Figure 2:
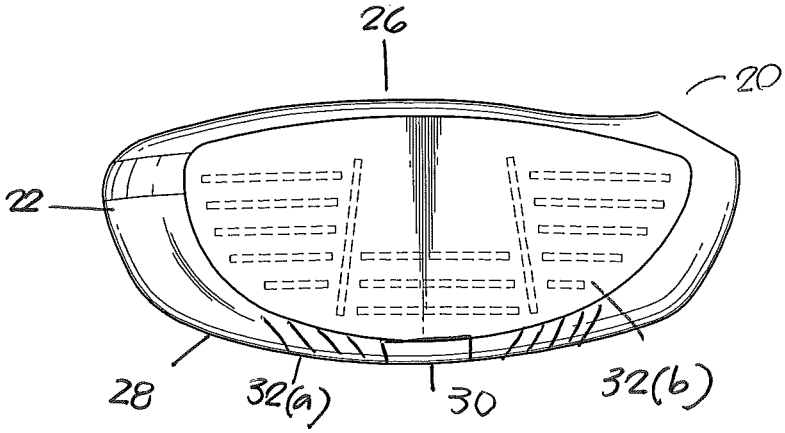
FIG. 2 is a front plan view thereof.
Figure 3:
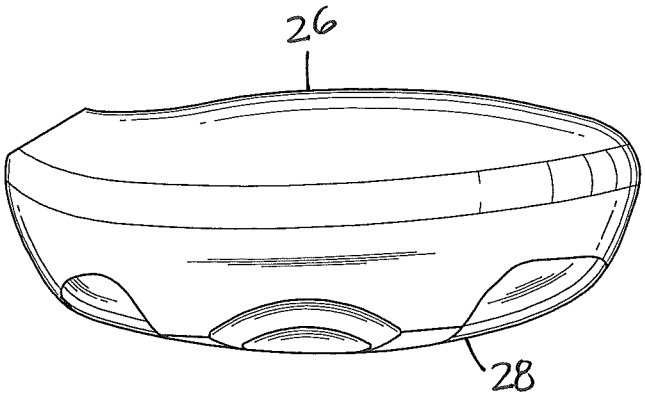
FIG. 3 is a rear view thereof.
Figure 4:
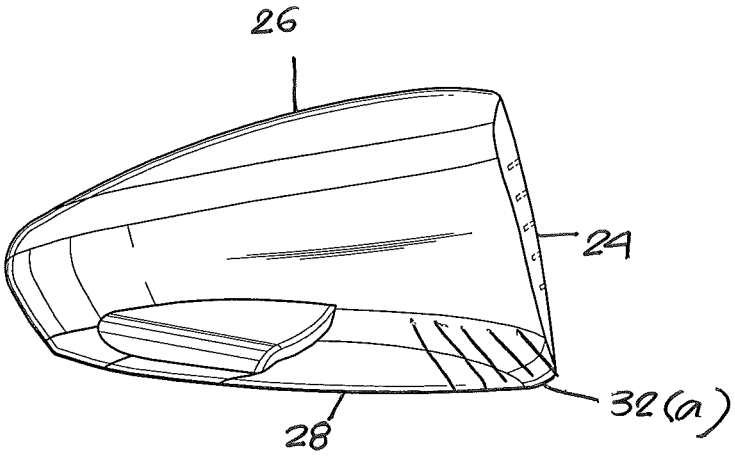
FIG. 4 is a toe end elevational view thereof.
Figure 5:
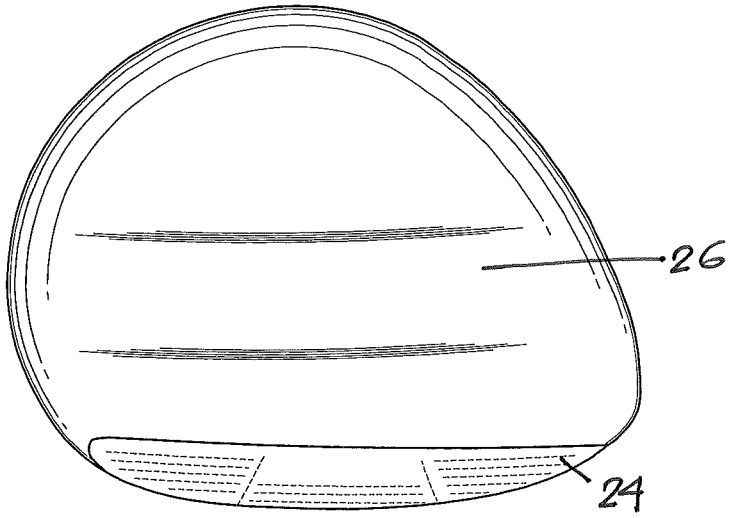
FIG. 5 is a top plan view thereof.
Figure 6:
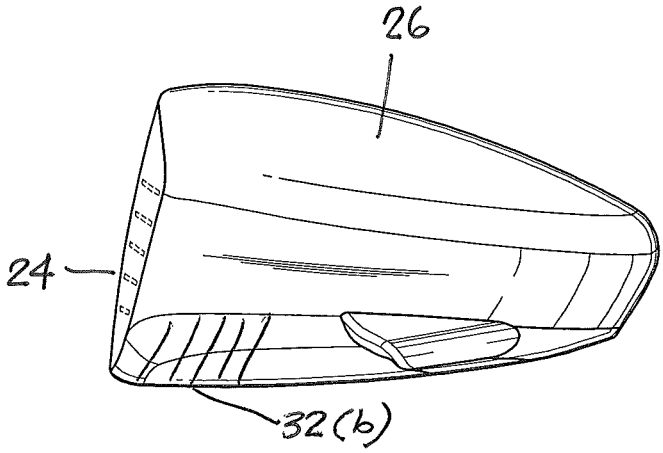
FIG. 6 is a heel end elevational view thereof.
Figure 7:
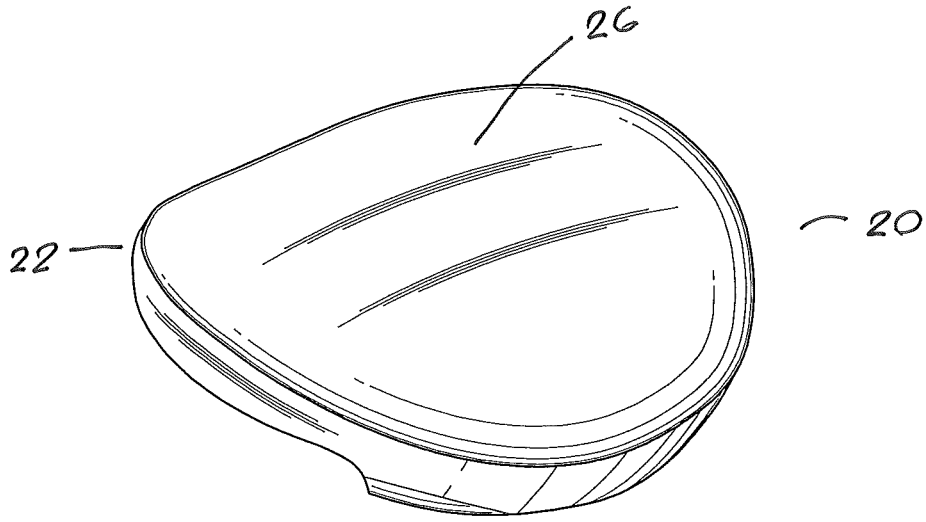
FIG. 7 is a top perspective view thereof.

As shown in the figures, a golf club head 20 preferably has a coated sole 26. The coating is preferably a low-friction, high release coating. A preferred coating is a TEFLON based coating. Alternatively a nano-metal coating may be used. Such nano-metal coatings are disclosed in U.S. patent Ser. No. 11/743,267 filed on May 2, 2007 for a Nanocystalline Plated Putter Head, which pertinent parts are hereby incorporated by reference. In another embodiment, the low friction, high-release coating is a Teflon material.

The present invention is a fairway-wood type golf club head 20 comprising a body 22 having a striking plate 24, a crown 26 and a sole 28, the sole 28 comprising a flat high strength region 30 and dual regions of a low friction, high-release coating 32*a-b*. In one embodiment, the striking plate 24 and the sole 28 are composed of a metal material and the crown is composed of a non-metal material.

The golf club head 20 preferably has a volume from 150 cubic centimeters to 420 cubic centimeters, more preferably from 200 cubic centimeters to 370 cubic centimeters. The volume of the golf club head 20 varies between fairway woods (preferably ranging from 3-woods to eleven woods).

The golf club head 20 preferably has a mass of 135 grams to 300 grams, and preferably from 140 grams to 185 grams.

The body 22 is preferably cast from molten metal in a method such as the well-known lost-wax casting method. The metal for casting is preferably titanium or a titanium alloy such as 6-4 titanium alloy, alpha-beta titanium alloy or beta titanium alloy for forging, and 6-4 titanium for casting. Alternatively, the body is composed of 17-4 steel alloy. Additional methods for manufacturing the body include forming the body from a flat sheet of metal, super-plastic forming the body from a flat sheet of metal, machining the body from a solid block of metal, electrochemical milling the body from a forged pre-form, casting the body using centrifugal casting, casting the body using levitation casting, and like manufacturing methods.

The center of gravity and the moment of inertia of a golf club head are preferably measured using a test frame ($X^T$, $Y^T$, $Z^T$), and then transformed to a head frame ($X^H$, $Y^H$, $Z^H$). The center of gravity of a golf club head may be obtained using a center of gravity table having two weight scales thereon, as disclosed in U.S. Pat. No. 6,607,452, entitled High Moment Of Inertia Composite Golf Club, and hereby incorporated by reference in its entirety. If a shaft is present, it is removed and replaced with a hosel cube that has a multitude of faces normal to the axes of the golf club head. Given the weight of the golf club head 20, the scales allow one to determine the weight distribution of the golf club head when the golf club head is placed on both scales simultaneously and weighed along a particular direction, the X, Y or Z direction. Those skilled in the pertinent art will recognize other methods to determine the center of gravity and moments of inertia of a golf club.

Reyes et al., U.S. Pat. No. 7,063,628 for a Plated Magnesium Golf Club Head discloses a method of a coating a sole of a golf club head and is hereby incorporated by reference in its entirety.

Galloway et al., U.S. Pat. No. 6,881,159 for a Multiple Material Golf Club Head discloses a fairway wood type golf club head and is hereby incorporated by reference in its entirety.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim as my invention the following:

1. A fairway-wood type golf club head comprising:

a body having a striking plate, a crown and a sole, the body composed of a stainless steel material, the sole comprising a flat high strength region and dual regions of a low friction, high-release nano-metal coating.

2. A fairway-wood type golf club head comprising:

a body having a striking plate, a crown and a sole, the body composed of a titanium alloy material, the sole comprising a flat high strength region and dual regions of a low friction, high-release nano-metal coating.

3. A fairway-wood type golf club head comprising:

a body having a striking plate, a crown and a sole, wherein the striking plate and the sole are composed of a metal material and the crown is composed of a non-metal material, the sole comprising a flat high strength region and dual regions of a low friction, high-release nano-metal coating.

* * * * *